US010329045B2

(12) United States Patent
Lelay et al.

(10) Patent No.: US 10,329,045 B2
(45) Date of Patent: Jun. 25, 2019

(54) TRAY MADE FROM CARDBOARD SHEET MATERIAL, BLANK, DEVICE AND METHOD FOR PRODUCING SUCH A TRAY

(71) Applicant: OTOR, Puteaux (FR)

(72) Inventors: Nicolas Lelay, Clichy (FR); Guillaume Pieras, Boissy-Saint-Leger (FR)

(73) Assignee: OTOR, Puteaux (FR)

( * ) Notice: Subject to any disclaimer, the term of this patent is extended or adjusted under 35 U.S.C. 154(b) by 532 days.

(21) Appl. No.: 15/025,142

(22) PCT Filed: Sep. 26, 2014

(86) PCT No.: PCT/FR2014/052424

§ 371 (c)(1),
(2) Date: Mar. 25, 2016

(87) PCT Pub. No.: WO2015/044616

PCT Pub. Date: Apr. 2, 2015

(65) Prior Publication Data

US 2016/0236810 A1 Aug. 18, 2016

(30) Foreign Application Priority Data

Sep. 27, 2013 (FR) ..... 13 59358

(51) Int. Cl.
*B65D 5/00* (2006.01)
*B31B 50/26* (2017.01)
(Continued)

(52) U.S. Cl.
CPC ..... *B65D 5/0045* (2013.01); *B31B 50/26* (2017.08); *B31B 50/60* (2017.08); *B65D 5/002* (2013.01);
(Continued)

(58) Field of Classification Search
USPC ..... 206/501, 503, 509, 736
See application file for complete search history.

(56) References Cited

U.S. PATENT DOCUMENTS 4,635,795 A * 1/1987 DeFlander ..... B65D 5/322 206/526
4,799,620 A * 1/1989 Vilella ..... B65D 5/0065 229/191

(Continued)

FOREIGN PATENT DOCUMENTS

| | | |
|---|---|---|
| DE | 86 10 403.9 U1 | 6/1986 |
| EP | 1 746 034 A1 | 1/2007 |
| GB | 2 281 066 A | 2/1995 |

OTHER PUBLICATIONS

Written Opinion of the International Searching Authority dated Jan. 30, 2015, issued in corresponding International Application No. PCT/FR2014/052424, filed Sep. 26, 2014, 5 pages.

(Continued)

*Primary Examiner* — Jacob K Ackun
(74) *Attorney, Agent, or Firm* — Christensen O'Connor Johnson Kindness PLLC

(57) ABSTRACT

A tray made from cardboard sheet material comprising a rectangular bottom and a ring of side walls, i.e., two first opposing side walls, referred to as first walls, at least one of the first walls being connected on either side by first fold lines to end flaps referred to as first flaps, which may or may not themselves be connected respectively at the top part of same to a second flap by a second fold line, and two second opposing side walls, referred to as second walls. The second walls each comprise a rectangular central panel of which the length is less than the length of the bottom, the panel being connected, at each of the lateral ends of same, by a third fold line to a reinforcing member forming a pillar folded and glued to the central panel, and/or to the first flap of the (Continued)

adjacent first wall, i.e., a first reinforcing element located entirely separated from the adjacent first wall, and a second reinforcing element.

10 Claims, 14 Drawing Sheets

(51) Int. Cl.

| | |
|---|---|
| ***B31B 50/60*** | (2017.01) |
| *B65D 5/20* | (2006.01) |
| *B65D 5/28* | (2006.01) |
| *B31B 50/81* | (2017.01) |
| *B31B 100/00* | (2017.01) |
| *B31B 120/40* | (2017.01) |
| *B31B 110/35* | (2017.01) |
| *B31B 120/00* | (2017.01) |

(52) U.S. Cl.
CPC ..... *B65D 5/005* (2013.01); *B31B 50/81* (2017.08); *B31B 2100/00* (2017.08); *B31B 2110/35* (2017.08); *B31B 2120/40* (2017.08); *B31B 2120/502* (2017.08); *B65D 5/2085* (2013.01); *B65D 5/28* (2013.01)

(56) References Cited

U.S. PATENT DOCUMENTS

| | | | | |
|---|---|---|---|---|
| 7,669,754 | B2 * | 3/2010 | Teixidor Casanovas | B65D 5/0045 229/117.01 |
| 2003/0209593 | A1 * | 11/2003 | Schilling | B65D 5/0025 229/174 |
| 2004/0041015 | A1 * | 3/2004 | Fry | B65D 5/0015 229/164 |
| 2009/0057382 | A1 | 3/2009 | Churvis | |
| 2014/0326782 | A1 * | 11/2014 | De Beer | B65D 5/002 229/117 |
| 2016/0122073 | A1 * | 5/2016 | Aguirre | B65D 5/443 206/509 |

OTHER PUBLICATIONS

International Preliminary Report on Patentability dated Mar. 29, 2016, issued in corresponding International Application No. PCT/FR2014/052424, filed Sep. 26, 2014, 1 page.

International Search Report dated Jan. 30, 2015, issued in corresponding International Application No. PCT/FR2014/052424, filed Sep. 26, 2014, 3 pages.

* cited by examiner

TRAY MADE FROM CARDBOARD SHEET MATERIAL, BLANK, DEVICE AND METHOD FOR PRODUCING SUCH A TRAY

The present invention relates to a tray made from cardboard sheet material comprising a rectangular bottom and a ring of side walls reinforced by pillars formed by folding of a part of the walls.

It also relates to a blank for producing such a tray and also to a device and to a corresponding method.

It applies particularly importantly, although not exclusively, to the field of trays for storing and for transporting packaged goods of any type (rigid or flexible), the use of which is not restricted to transportation (requiring satisfactory stiffness and good compression strength), but is also suited to the storage and to the display of goods on shelves.

Such trays may be produced in modular form and thus allow a mixing of forms, which makes them suited to the delivery and/or to the simultaneous promotion of a variety of different goods.

If the trays are used with a lid they are easy to open. When open on the side they then enable the goods to be viewed, likewise making them directly accessible to consumers.

Corrugated cardboard trays provided with corner pillars obtained by folding of end flaps are already known (FR 2 747 643).

Although they offer good compression strength, such trays do not enable the goods to be displayed on the sides.

Modular trays provided with supporting elements that can be connected to the tray above by means of side pillars obtained by folding are also known (EP 2 036 827).

Such packaging requires the presence of joining rods and is thus complex to implement.

The present invention aims to provide a tray, a blank made from cardboard sheet material, a device and a method for producing such a tray, said tray responding better than those known hitherto to practical demands, notably by proposing a tray that allows a use adapted to all sizes of goods, homogenous linear POS or palletized display, optimizing the selling space, and facilitating access to the goods while allowing excellent identification of brand, doing so with the possibility of automatic high-throughput production (higher than thirty strikes/minute).

With the invention, multiple packing costs are furthermore reduced owing to the modular nature of the trays, which can be stored for different goods on one and the same pallet.

Similarly, an optimized strength/surface area/weight ratio is obtained, this being with one carton, which may be entirely recycled, thereby reducing $CO_2$ emissions.

Lastly, such a tray makes it possible to limit the number of movements required for rendering the tray linear, eliminating the need for a sharp blade and/or pre-cuts at the time of placing on shelves.

To this end the invention proposes, notably, a tray made from cardboard sheet material comprising a rectangular bottom and a ring of side walls, i.e. two first opposing side walls, referred to as first walls, at least one of said first walls being connected on either side by first fold lines to end flaps, referred to as first flaps, which may or may not themselves be connected respectively at the top part to a second flap by a second fold line, and two second opposing side walls, referred to as second walls, characterized in that the second walls each comprise a rectangular central panel of length shorter than the length of the bottom, said panel, being connected, at each of the lateral ends of same, by a third fold line to a reinforcing element forming a pillar folded and glued to said central panel, and/or to the first flap of the adjacent first wall, i.e. a first reinforcing element located entirely separate from said adjacent first wall, and a second reinforcing element.

In advantageous embodiments, one and/or another of the following arrangements are employed in addition and/or alternately:

- the first reinforcing element is formed by a vertical tongue glued to the inner or outer face of the corresponding second wall;
- the first reinforcing element is formed by two tongues connected together by fourth, fold lines folded and glued to one another at 180°;
- the first reinforcing element is formed by three rectangular vertical tongues connected together by fourth fold lines, the two first tongues forming said pillar of triangular transverse section and the third, end, tongue being glued to the inner face of the corresponding second wall or to the first flap of the adjacent first wall;
- the first reinforcing element is formed by four rectangular vertical tongues connected together by fourth fold lines, the two or three first tongues forming said pillar of triangular, rectangular or trapezoidal transverse section and the end fourth tongue being glued to the inner face of the corresponding second wall or to the first flap of the adjacent first wall;
- the end tongue comprises an end forming a tenon protruding relative to the height of the second wall, the bottom of the tray comprising apertures of complementary form arranged in line with said tenons for recessed fitting of the tenons of the tray below;
- the central panel, of each of the second walls is off-center relative to the central axis of the tray perpendicular to said second walls;
- one of the side ends of each central panel of a second wall is adjacent to one and the same first wall in order to form a corner pillar with the corresponding reinforcing element, the other end of said panel being located at an intermediate level of said second wall in order to form an intermediate pillar with the other of the reinforcing elements thereof;
- the reinforcing elements are symmetrical relative to the central axis of the tray perpendicular to the second walls to form intermediate pillars;
- at least one of the first walls comprises at the top part a third flap connected to said first wall by a fifth, double, fold line, said third flap being folded toward the inside of the tray on the inner face of said corresponding first wall;
- each of the first walls comprises a third flap;
- the first wall(s) provided with third flaps are shorter than the second walls, the end first flaps having a trapezoidal or partially trapezoidal form and being connected to the corresponding second flaps by sixth, double, fold lines, which are oblique relative to the fifth fold line;
- the first flaps comprise, moreover, fourth flaps connected respectively to said first flaps by seventh fold lines and located on the side opposite the second flap relative to the first flap;
- the fourth flaps are of trapezoidal form, are glued to the outer face of the bottom of the tray and are arranged in order to coincide at least in part with the upper periphery of a side of the pillar of the tray below.

The invention also proposes a blank that makes it possible to obtain a tray such as that described above.

The invention also proposes a blank, for constituting a tray, comprising a rectangular bottom connected by joining lines to four rectangular leaves capable of forming the walls of the tray, i.e. two first opposing leaves, at least one of said first leaves being connected on either side by first fold lines to end flaps referred to as first flaps, which are themselves connected on their periphery, on the side opposite that located in the extension of the corresponding joining line of the first leaf, to two second flaps by second fold lines, and two opposing adjacent side second leaves, characterized in that the second leaves each comprise a rectangular central panel of a length shorter than the length of the bottom, said panel being connected at each of the side ends thereof by a third fold line to an element capable of forming a pillar upon forming of the tray.

In an advantageous embodiment the element capable of forming a pillar is formed by two, three or four rectangular tongues connected together by fourth fold lines, the first tongues being capable of forming the pillar and the last, end, tongue being capable of being glued to the inner face of the corresponding second wall.

Advantageously, the blank is characterized in that at least one of the first leaves comprises, at the outer periphery, a third flap connected to said first leaf by a fifth, double, fold line, said third flap being arranged in order to be folded toward the inside when the tray is formed, on the inner face of said corresponding first leaf.

The invention also proposes a method and a device for forming a tray such as that described above.

The invention also proposes a method for forming a tray from a blank comprising a rectangular bottom connected by joining lines to four rectangular leaves capable of forming the walls of the tray, i.e. two first opposing leaves, at least one of said first leaves being connected on either side by first fold lines to end flaps referred to as first flaps, which are themselves connected on their periphery, on the side opposite that located in the extension of the corresponding joining line of the first leaf, to two flaps by second fold lines, and two opposing adjacent side second leaves, characterized in that the second leaves each comprise a rectangular central panel of a length shorter than the length of the bottom, said panel being connected at each of the side ends thereof by a third fold line to a reinforcing element provided with a joining face with the side second leaf, The blank is removed from a vertical stack of flat blanks, the blank is transferred toward a first station for deployment of said reinforcing elements, with said joining faces of said reinforcing elements receiving glue during transfer, counter-pressure pieces are brought in line with the third fold lines above the blank, said counter-pressure pieces receive, under pressure, said reinforcing elements on the side opposite said joining face, with corresponding shapers of a form complementing the form of the deployed reinforcements in order to form pillars by folding, the counter-pressure pieces and the shapers are removed, the blank with the deployed reinforcing elements are transferred, with the first and the second flaps receiving glue, toward a final forming station, the tray is formed at said final forming station by raising of a cavity or piston-like movement by a vertical punch in a cavity, and the tray thus formed is ejected.

Advantageously, the reinforcing element capable of forming a pillar is formed by three or four rectangular strips connected together by joining lines, the two first or three first strips being arranged in order to form said pillar of triangular or polygonal transverse section and the third or fourth end strip being capable of gluing the end tongue on the inner face of the second wall of the corresponding formed tray.

The invention also proposes a device for implementing the above method and/or for producing a tray such as that described above.

The invention will be better understood upon reading the following description of embodiments given below by way of non-limiting examples. The description relates to the drawings that accompany the description, in which.

Figure 9:
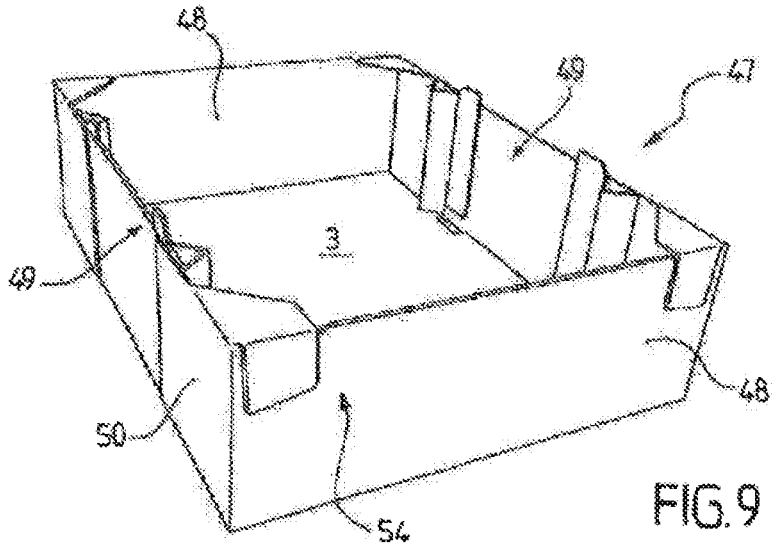
Figure 10:
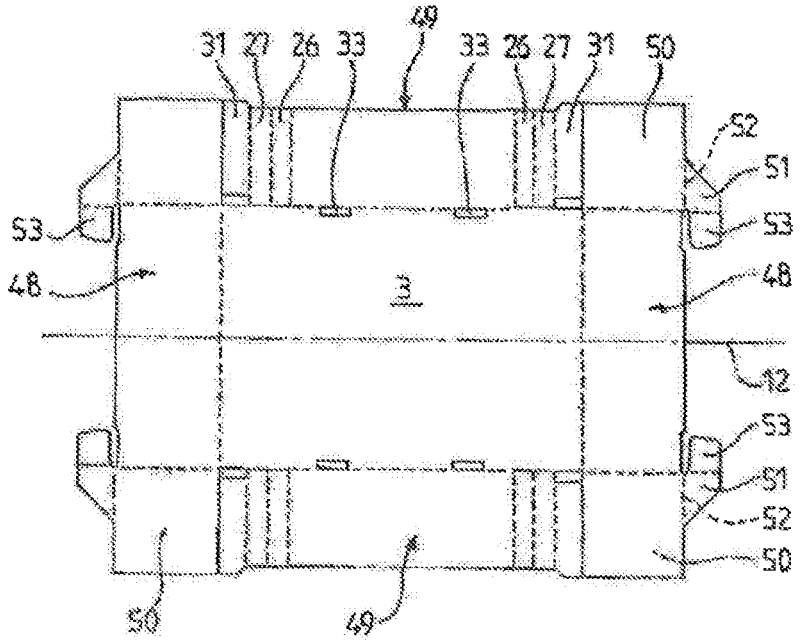

FIGS. 9, 10 on the one hand and 11, 12 on the other show, respectively, trays and blanks for fifth and sixth embodiments of the invention, with first walls and second walls of identical heights.

Figure 1:
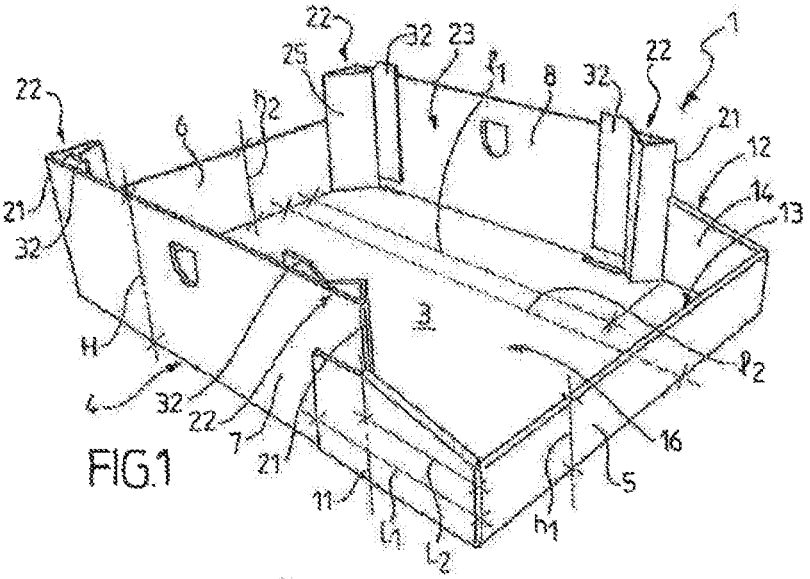
FIG. 1 is a perspective view of a tray according to a first embodiment of the invention.
Figure 13:
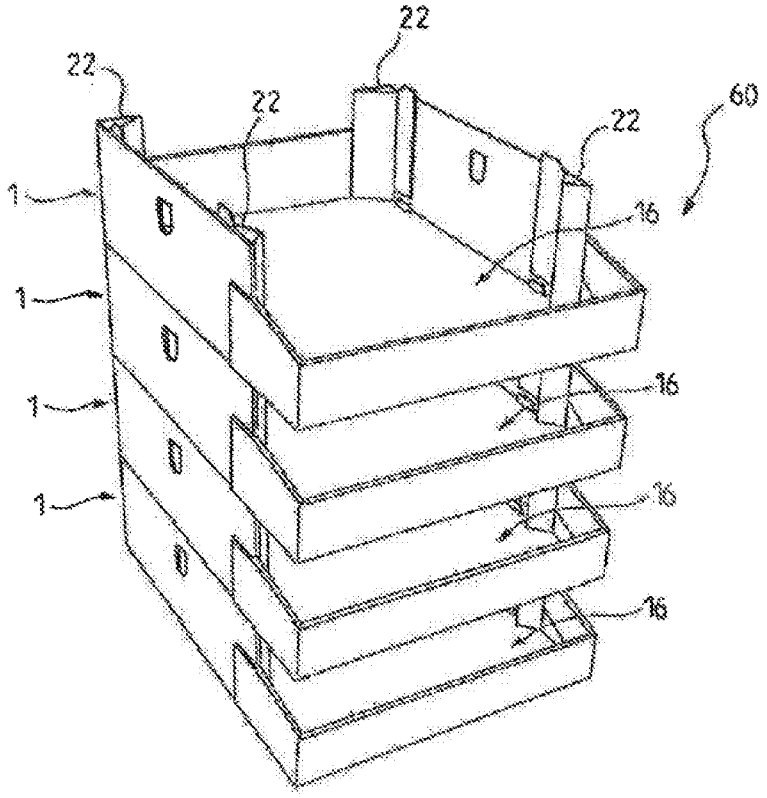

FIG. 13 shows a stack of trays nested one on another, according to the embodiment of FIG. 1.

Figure 14C:
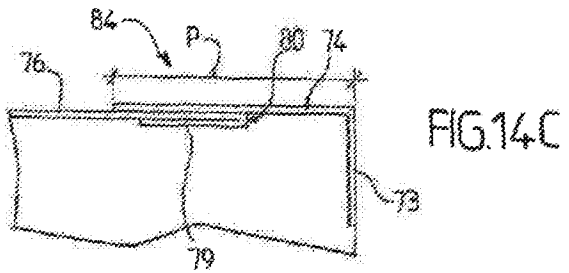
Figure 14B:
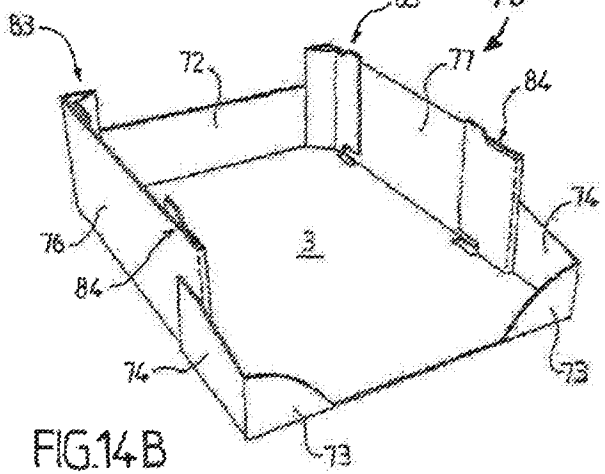
Figure 14A:
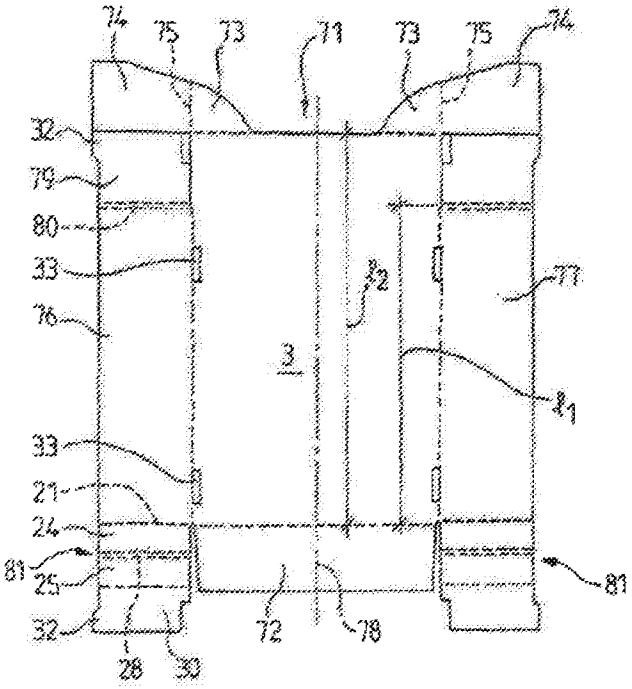

FIGS. 14A and 14B are, respectively, a plan view of a blank and a perspective view of the tray produced with such a blank, according to a further embodiment of the invention.

FIG. 14C is a schematic sectional view of an intermediate pillar of the tray of FIG. 14B.

Figure 14D:
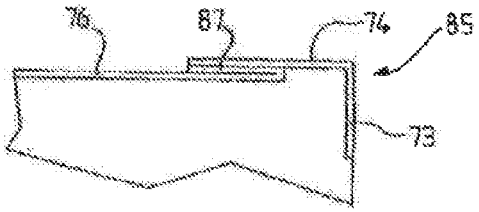
Figure 14E:
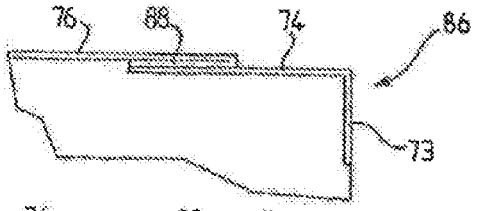

FIGS. 14D and 14E are schematic sectional views of further embodiments of intermediate pillars for a tray according to the invention, with a tongue.

FIGS. 15A to 15D are sectional views of intermediate pillars according to further embodiments of the invention, with two tongues.

FIGS. 16A to 16F and 17A to 17C are, respectively, sectional views of intermediate pillars with three tongues and sectional views of intermediate pillars with four tongues, according to further embodiments of the invention.

Figure 18A:
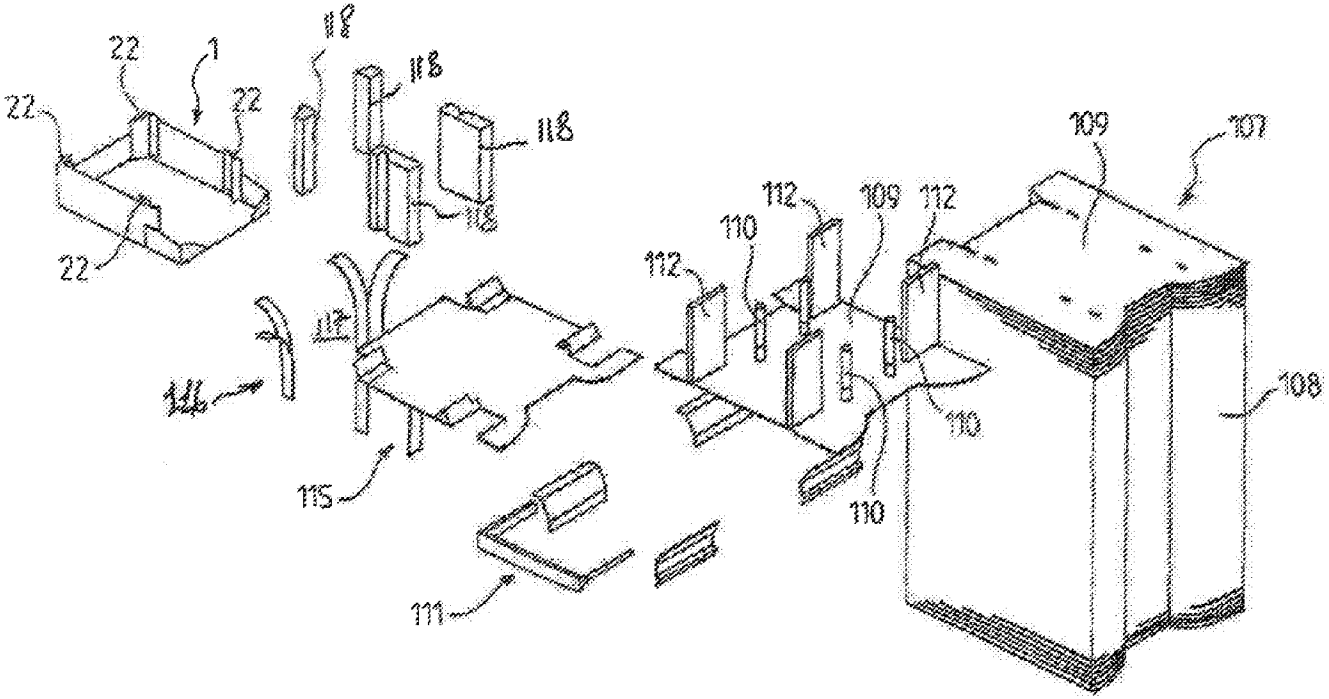
Figure 18B:
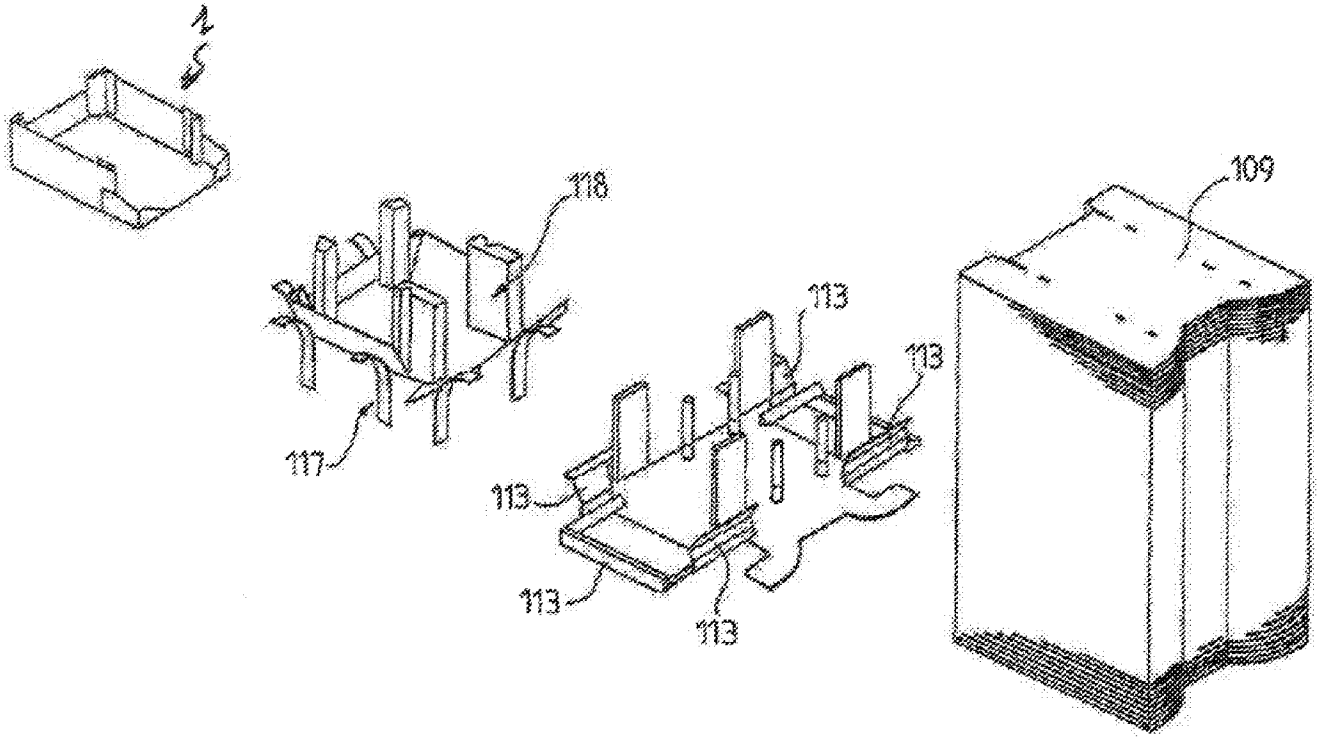
Figure 18C:
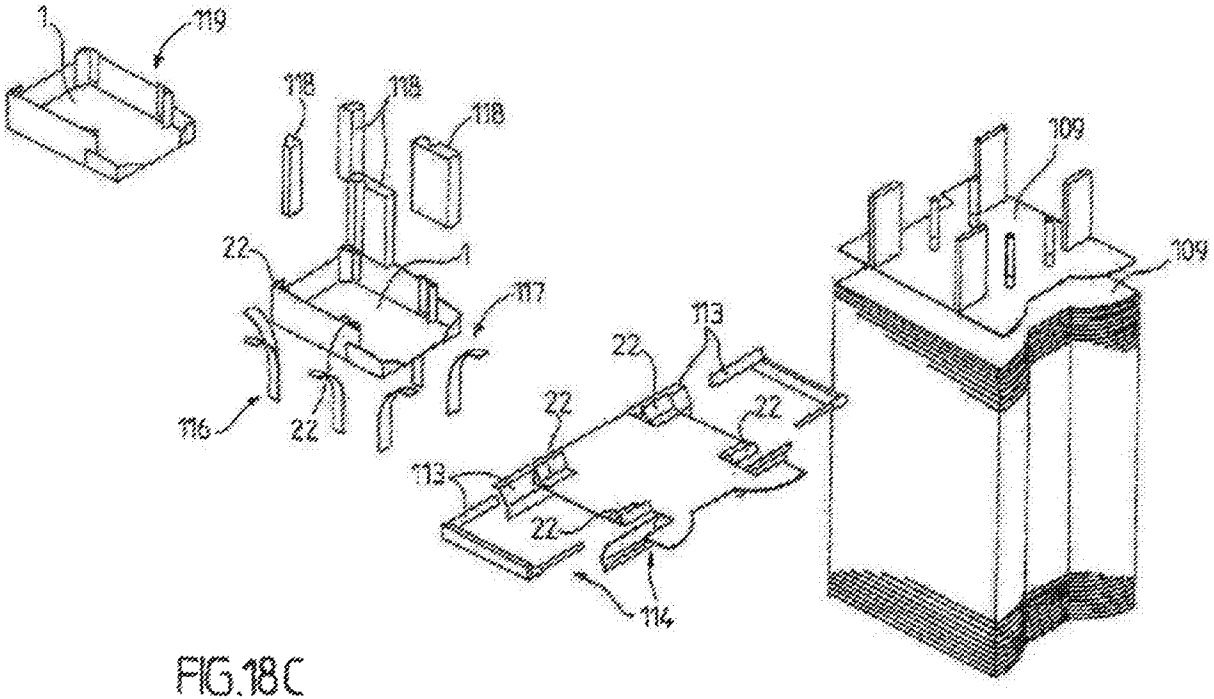

FIGS. 18A to 18C show schematic perspective views illustrating an embodiment of a device according to the invention and also the steps implemented by the corresponding method.

Figure 2:
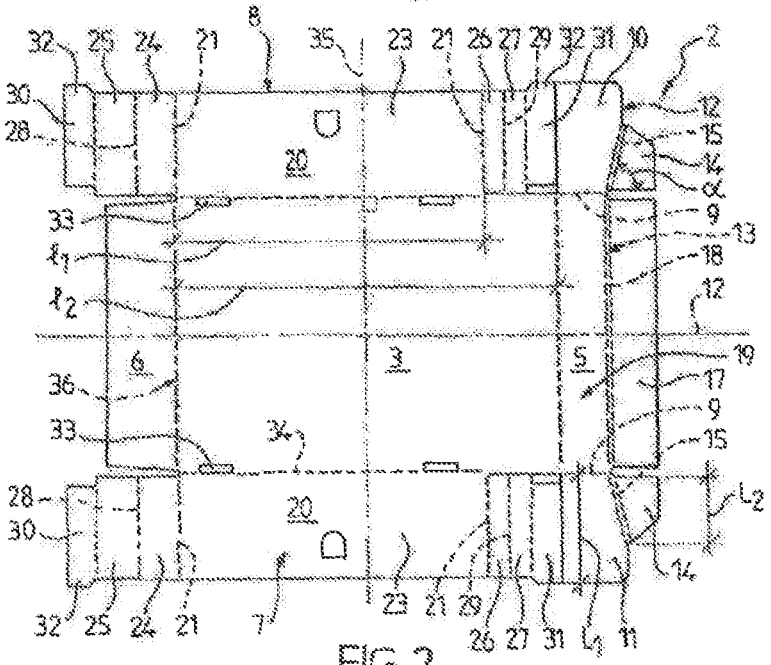
FIG. 2 is a plan view of the blank for producing the tray of FIG. 1.

FIGS. 1 and 2 show, respectively, a tray 1 and a blank 2 made from corrugated cardboard sheet, three millimeters thick, for example, comprising a rectangular bottom 3 and a ring 4 of side walls or leaves, i.e. two first opposing walls or leaves 5, 6 and two second opposing walls or leaves 7, 8.

The first wall 5 is rectangular and connected on either side by first fold lines 9 to rectangular or substantially rectangular (for example trapezoidal or partially trapezoidal, with an angle at the base of between 5° and 45°) end flaps 10, 11, which are symmetrical relative to the longitudinal axis 12 of the blank 2.

The end flaps 10, 11 are themselves connected at the top part, that is to say at the outer periphery 12 parallel and/or in the extension of the upper periphery 13 of the first leaf 5, to second flaps 14, via double fold lines 15 oblique toward the axis 12 and the center of the panel 3, for example at an angle $\alpha$ relative to the axis of between 80° and 45°, for example 70°.

The width L1 of the flaps 10 and 11 and the width L2 of the second flaps are such that there is partial overlap with the facing second leaf 7 when the flaps are folded in order to form the tray (cf. FIG. 1). By adjusting the widths L1 and l2 (L1<L2) and also the dimensions of the reinforcing elements forming, in the embodiment, concertina pillars that will be described below, a draw/display unit 16 of reasonably sizable width L2 is thus produced.

The first wall or first leaf 5 comprises, moreover, at the peripheral top part 13, a rectangular third flap 17 connected to the first wall by a fifth, double, fold line 18, that is to say sufficiently thick to allow the folding of the third flap 17 on the inner face 19 of the first wall.

The leaf 5 is of height h1 and the flap 6 of height h2>h1, but shorter than the height H of the second leaves, which will now be described.

The tray comprises, in effect, moreover, two second leaves or walls 7 and 8, each comprising a rectangular central panel 20 of height H, length 11 shorter than the length 12 of the bottom, for example of between ½ and ⅘ of said length 12, for example equal to ¾.

Each central panel 20 is connected at each of the ends thereof, by means of a third fold line 21, to a concertina element 22 forming a pillar, folded and glued on the inner face 23 of the central panel.

More precisely, and in the embodiment more particularly described here, each concertina element is formed by three vertical tongues parallel to the third fold line 21, i.e. a first and a second tongue 24, 25 and 26, 27, which are rectangular and identical in pairs, connected, respectively, to one another by fold lines 28 or 29, and a third tongue 30, 31, which is substantially rectangular and of a shorter length (comprising a notch at the bottom part) capable of being glued, or glued when the tray is formed, onto the corresponding inner face 23.

Each of the third tongues 30, 31 comprises, at the top part, an end 32 forming a tenon, for example of trapezoidal form, protruding relative to the periphery of the second leaf and/or to the height H of the second wall, and a corresponding notch at the bottom part.

The bottom 3 of the tray, meanwhile, comprises apertures 33 (slots) of a shape that complements the tenons of the tray below, which are upright in the case of stacking of one on another. More precisely, the slots are rectangular and of the thickness or slightly larger than the thickness of the corrugated cardboard and have a side merged with the joining line 34 between the bottom 3 and the second flaps 7 and 8.

In the embodiment of FIGS. 1 and 2, the central panels 7 and 8 are off-center relative to the transverse central axis 35 of the tray perpendicular to the second walls, one of the ends of the panels (fold line 21) being adjacent one and the same first wall 6, which is here constituted by a rectangular or substantially rectangular panel devoid of flaps, in order to form a corner pillar with the corresponding concertina element 22.

The fold line 21 is thus, when the blank is laid flat, in the extension of the joining line 36 between the first leaf 6 and the bottom 3.

The other pillar 22, associated with the same panel, is, meanwhile, arranged at the other end, in an intermediate position relative to the wall, and serves as external support point to the part 16 forming a corbel or overhang relative to the tray below.

In the remainder of the description use will preferably be made of the same reference numbers to denote the same elements or similar elements.

Figure 3:
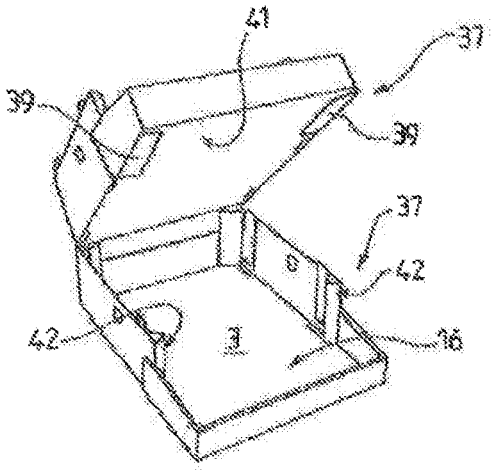
FIG. 3 is a perspective view of a partial stack of two trays according to a second embodiment of the invention, with centering devices.
Figure 4:
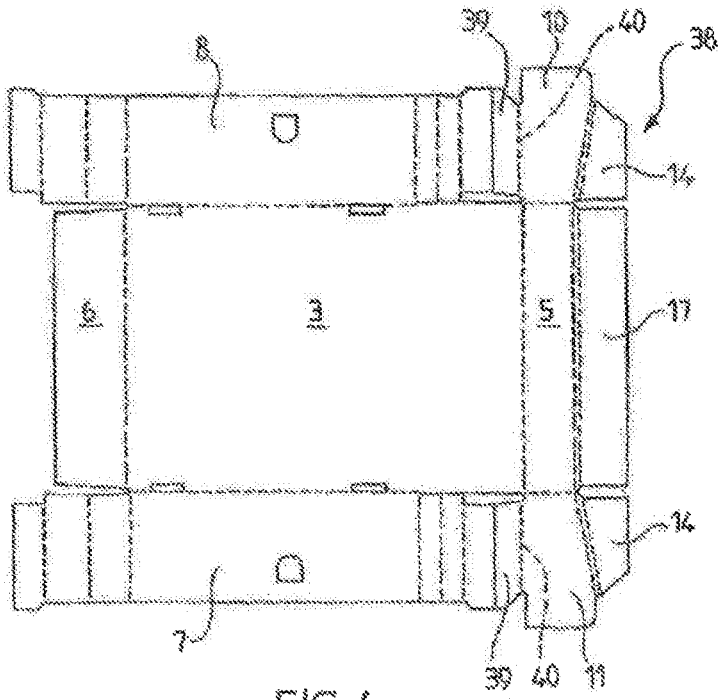
FIG. 4 is a plan view of the blank for producing a tray of FIG. 3.

FIGS. 3 and 4 show trays 37 and a blank 38 that differ from the tray and blank described above only in that the former are provided, moreover, with fourth, trapezoidal, flaps 39 connected, respectively, to the first flaps by seventh fold lines 40, and located on the side opposite the second flap 14 relative to the first flap.

The fourth flaps are folded on the outer face 41 of the bottom 3 of the tray on which they are glued, in order to constitute centering devices arranged in order to coincide with a side 42 at the top of the pillar 22 of the tray below.

The fourth flaps 39, moreover, consolidate the corbel part 16, which is thereby rendered more stable.

Figure 5:
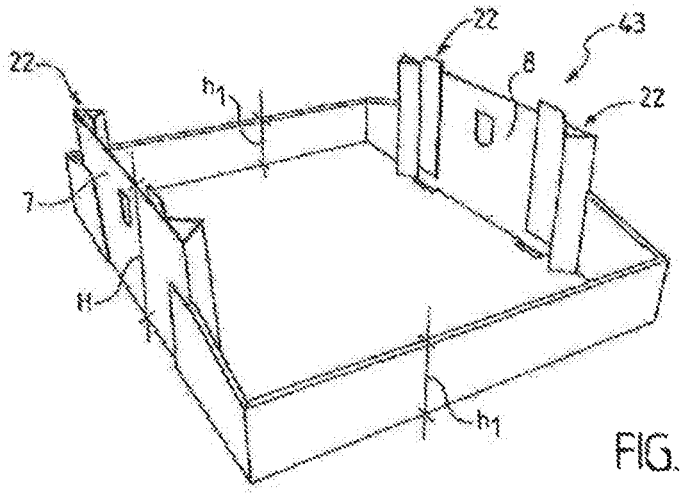
FIGS. 5 and 6 are, respectively, perspective views of a tray according to a third embodiment and of the flat blank for producing such a tray.
Figure 6:
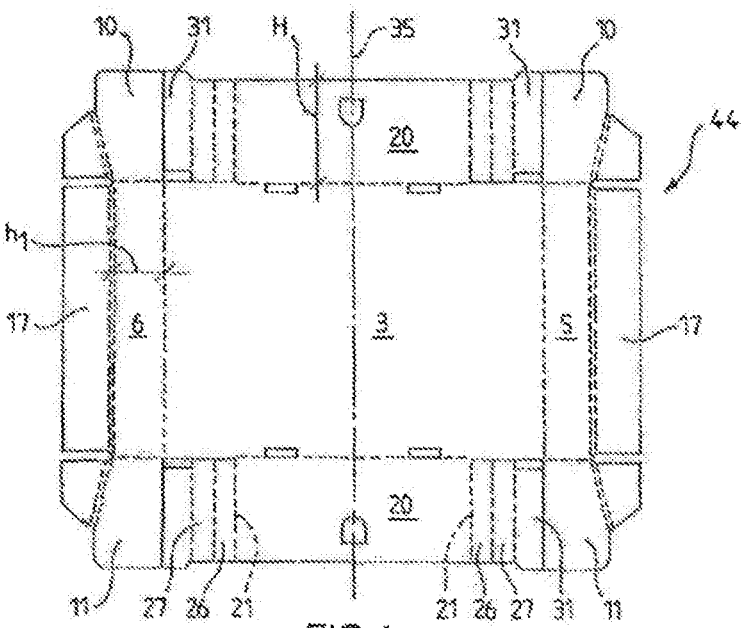

FIGS. 5 and 6 show a variant of tray 43 and blank 44 for producing the tray, which are very similar to the tray and blank of FIGS. 1 and 2 but have a configuration of pillars 22 that are symmetrical relative to the transverse axis 35 of the tray, thus leaving two openings since h1<H.

Figure 7:
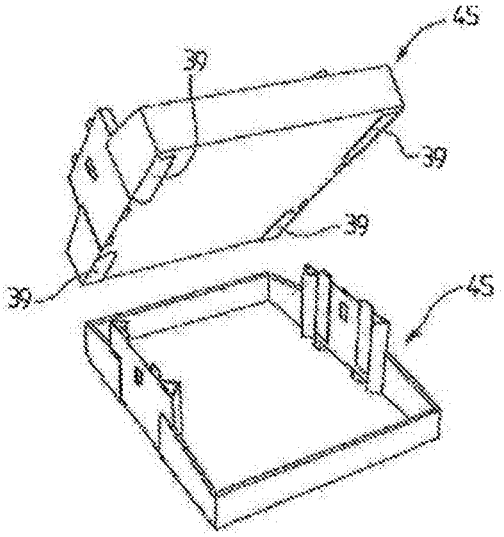
FIGS. 7 and 8 are perspective views of a fourth embodiment of trays according to the invention (FIG. 7) and of the blank for producing such trays.
Figure 8:
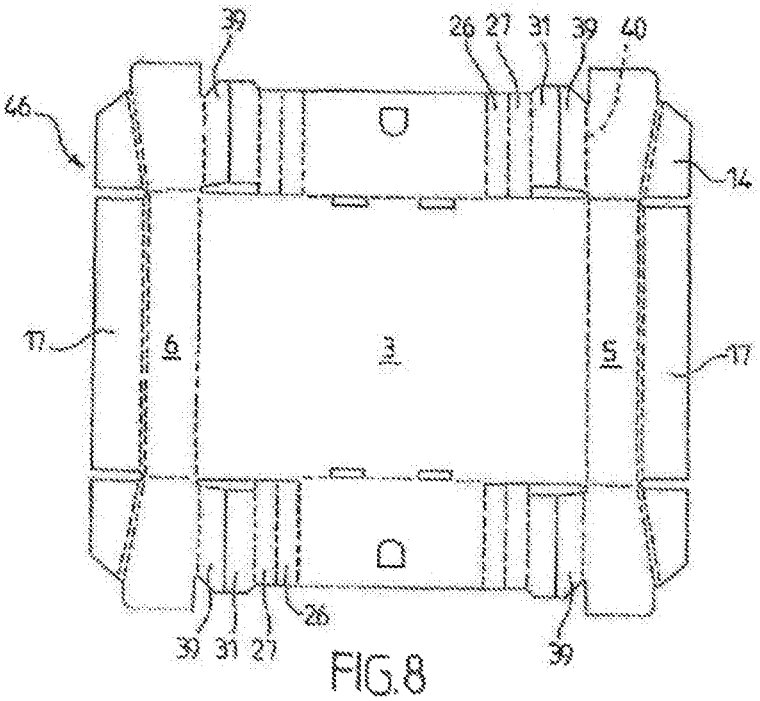

FIGS. 7 and 8 are an embodiment of tray 45 and blank 46 comprising, on the one hand, third flaps 17 on each of the first leaves 5-6 and, on the other, trapezoidal fourth flaps 39 in order to form poka-yoke means and/or reinforcements, as described with reference to FIGS. 3 and 4.

FIGS. 9 and 10 show a tray 47 provided with four walls 48, 49 of the same height, i.e. two identical first walls or leaves 48 and two identical second walls or leaves 49.

The identical rectangular first leaves 48 are provided with two end first flaps 50, which are symmetrical relative to the longitudinal axis 12 of the tray.

Each first flap 50 is provided with a second flap 51 attached by a fold line 52 on the outer peripheral side opposite the side of the first flap arranged in order to coincide with the joining line 34 with the second flaps 49, and a fifth hook flap 53 capable of being folded and glued on the outer face 54 of the corresponding first leaves 48.

Figure 11:
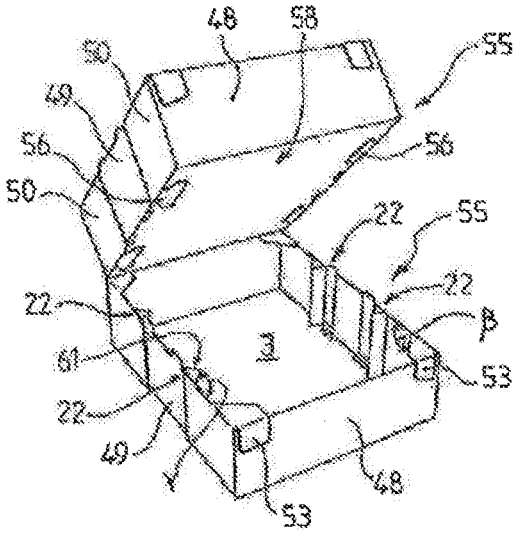
Figure 12:
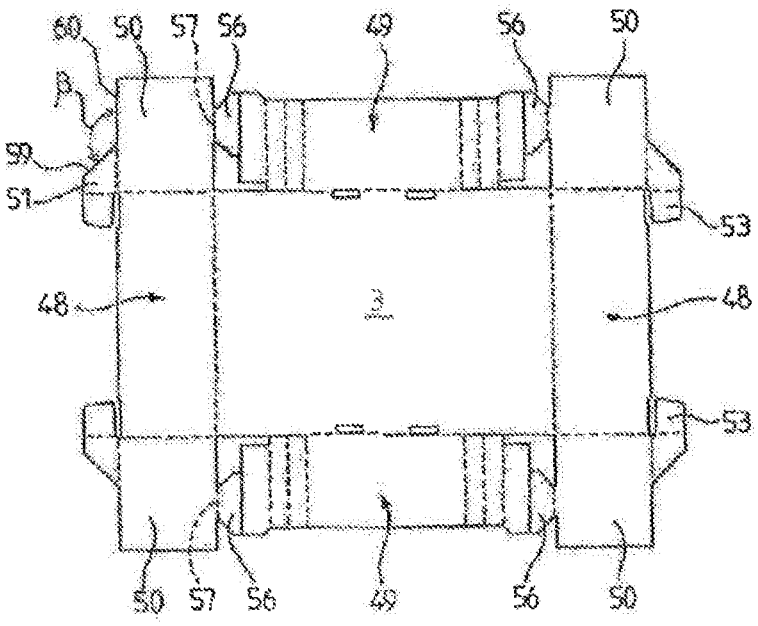

FIGS. 11 and 12 show a variant of FIGS. 9 and 10, the trays 55 here being provided with four pillars 22 and four leaves 48 and 49, of the same heights, with a fourth hook flap 53.

They comprise, moreover, fifth flaps 56 in the form of an isosceles trapezium, which are attached by fold lines 57 and capable of being glued on the outer face 58 of the bottom of the tray.

The angle β of the hook between the oblique periphery 59 thereof and the end 60 of the first flap on which the second flap 51 is affixed and the angle γ of the oblique wall of the triangle 61 formed by the pillar of triangular transverse section with the inner wall of the leaf 49 complement the form of the trapezium of the fifth flap such that there is recessed fitting of this flap between the two elements formed by the fifth hook flap 53 once glued and the top of the pillar 22.

A complementary centering element is thus constituted.

FIG. 13 shows a stack 60 of tray 1 according to the embodiment described with reference to FIG. 1.

The pillars 22 superposed one above another in an adjusted manner by virtue of the centering elements take up the compression forces while leaving a corbel. 16 permitting access to and/or viewing of the elements contained in the trays.

A description will now be given of the manufacture of a tray 1 and of a stack 60 according to an embodiment of the invention, with reference to FIGS. 1, 2 and 13.

Starting with a laid-flat blank, the pillars are formed by concertina folding of the elements 22 (after the inner face of the end third tongue 30 has received glue).

Next, the leaves 7 and 8 are righted and the side ends of the first leaf 6 receive glue and are pressed on the outer face of the tongue 21, the latter being arranged with the remainder of the pillar element in order to be perpendicular to the leaves 8, 7 during forming.

The first leaf 5, meanwhile, is formed by folding of the flaps 14 in a form arranged in order to be properly recess fitted between the pillar on one side and the first wall on the other. Provision is then made for gluing of these latter on the inner face of the corresponding first flap, the third flap itself being folded and/or glued on the inner face of the corresponding leaf 5, and then the whole assembly is folded and the ends devoid of the flaps 10, 11 are glued on the outer face of the adjacent second leaf 7, 8 in order thus to constitute the trays that will subsequently be stacked in order to form a very strong multimodular palletizable system, as shown in FIG. 13.

FIGS. 14A, 14B and 14C show a further embodiment of a tray 70 and/or of the component elements thereof, comprising a rectangular bottom 3 and first walls 71 and 72.

The first wall 71 is completely open at the center thereof and formed by two end portions 73 in the form of a portion of an arc of a circle or of a curve (the remainder of the wall thus being totally absent), and comprises the end flaps 74 connected to the curved end portions by the first fold lines 75.

The other first wall 72 is simply rectangular, without a flap. The tray also comprises two identical second walls 76, 77, which are symmetrical relative to the longitudinal axis 78 of the tray, the length $l_1$ of said panel being shorter than that $l_2$ of the bottom. Each of the walls or panel 76, 77 comprises, on the one hand, a reinforcing element 79 formed by a rectangular flap connected to the panel by a double fold line 80 located at a distance $l_2-l_1$ from the fold line of the bottom with the first flap 71.

It comprises, on the other hand, a reinforcing element 81 of the type described with reference to FIG. 2, i.e. a first tongue 24 connected to the panel by a fold line 21, a second tongue 25 connected to the first tongue by a fold line 28, for example in this case a double fold line, and a third tongue 30, all these three tongues forming a corner pillar 83 of triangular section.

Ends 32 on the end flaps will allow centering in the apertures 33, as described above, notches being provided at the lower part of the flaps 79 in order to free the facing apertures 33 and to allow recessed fitting (as in FIG. 2).

FIG. 14C shows, in section, the reinforcement 84 produced with the flap 79 folded at 180° and glued on the inner face of the leaf 76.

The length p of the flap 74 is dimensioned, i.e. is of sufficient length, to allow facing gluing thereof on the outer face of the wall 76, for example over a distance greater than the width of the tongues 79.

FIGS. 14D and 14E show two further embodiments 85 and 86 of a pillar with a tongue 87 and 88, either affixed by gluing on the outer face of the panel 76 and on the inner face of the flap 74 (FIG. 14D), or affixed on the inner face of the panel 76 and on the outer face of the flap 74 (FIG. 14E).

FIGS. 15A to 15D are schematic sectional views of an intermediate reinforcement 87, 88, 89, 90 with two tongues 91, 92, respectively folded at 180° and glued one on another and on the inner face of the flap 74, which itself may (FIG. 15A) or may not (FIG. 15B) be affixed by gluing on the outer face of the panel 76.

Figure 15A:
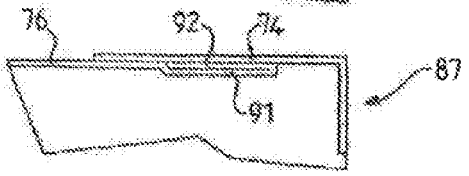
Figure 15B:
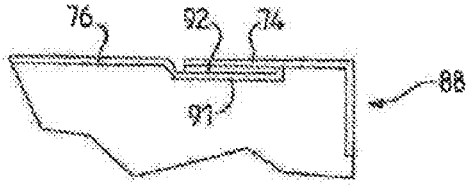
Figure 15C:
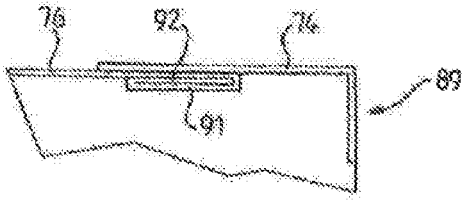
Figure 15D:
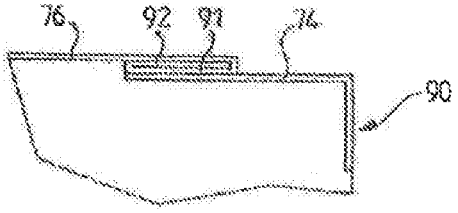

FIGS. 15C and 15D show a first tongue 91 folded at 180° relative to the panel 76, the second tongue 92 being sandwiched between the inner face of the panel 76 and said first tongue, with the inner face of the flap 74 glued on the wall 76 (FIG. 15C) or on the outer face of the first tongue 91 (FIG. 15D).

In these latter two cases, the joining line between the two tongues is a double fold line to allow turning-over.

Figure 16A:
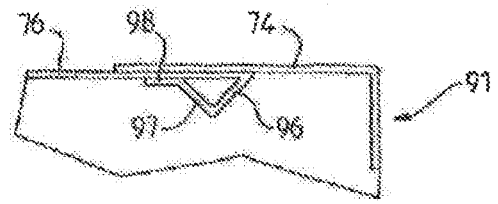
Figure 16B:
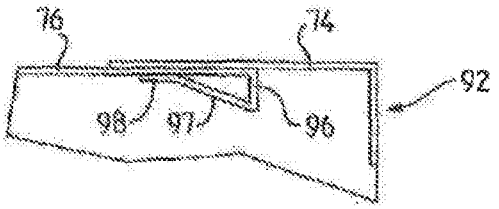
Figure 16C:
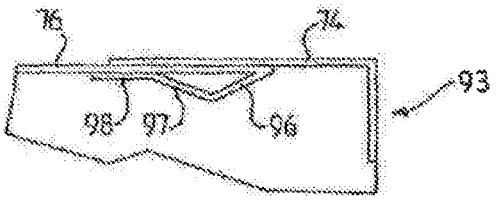
Figure 16D:
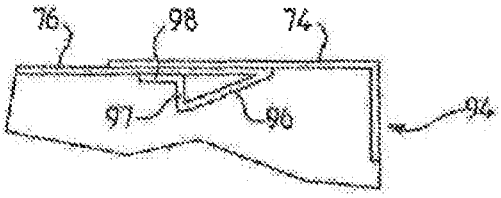
Figure 16E:
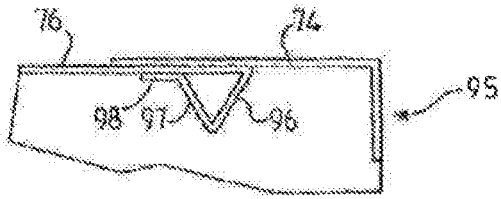
Figure 16F:
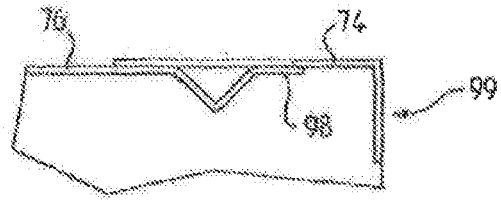

FIGS. 16A and 16F show six embodiments of intermediate pillars with three tongues, allowing the formation of a pillar of diverse triangular section, concertinaed in the first five embodiments 91, 92, 93, 94, 95.

Here, the tongues 96, 97, 98 are such that the first tongue 96 is folded toward the inside of the wall 76 at a reasonably acute angle, the second tongue being reasonably long (relative to the length of the first tongue) in order to form an equilateral triangle (FIG. 16A), a right-angled triangle on the first tongue (FIG. 16B), an isosceles triangle (FIG. 16C), a right-angled triangle on the second tongue (FIG. 16D), or any triangle (FIG. 16E).

In these five embodiments, the third tongue 98 is, meanwhile, glued on the inner face of the wall 76.

The sixth embodiment 99 is that of FIG. 16F.

Here, the first tongue 96 is folded toward the outside, the third tongue 98 being glued on the inner face of the flap 74.

In all cases, this latter is of sufficient length to be glued on the outer face of the wall 76.

Figure 17A:
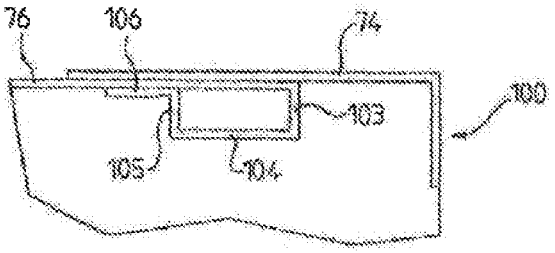
Figure 17B:
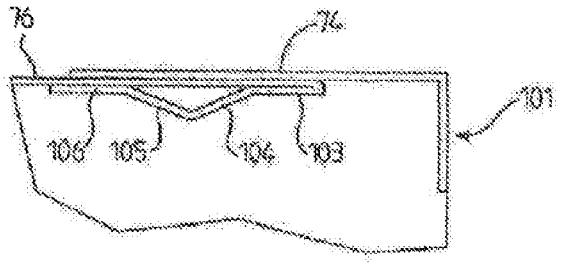
Figure 17C:
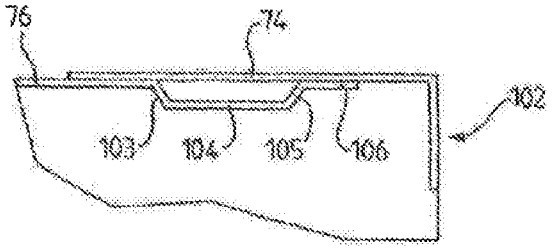

FIGS. 17A to 17C show intermediate pillars 100, 101, 102 produced with four tongues 103, 104, 105, 106.

FIG. 17A shows a pillar of square section, the last tongue 106 being glued on the inner face of the panel 76.

FIG. 17B shows a first tongue 103 folded at 180°, glued on the inner face of the panel 76, the following two tongues forming a triangle, the last tongue here again being glued on the inner face of the panel 76.

Lastly, FIG. 17C shows an embodiment equivalent to that of FIG. 16F, but with four tongues, giving the pillar a configuration with a trapezoidal section.

FIGS. 18A to 18E show a device and a method for forming the tray 1 according to the embodiment of the invention more particularly described here.

From a magazine 107 for flat storage of a stack 108 of blanks 109, the latter are taken by suction means 110, which are known per se, and transferred toward a first station 111 for deployment of the reinforcing elements 22, with gluing (injector gun, not shown) the joining faces of said reinforcing elements during transfer.

Counter-pressure pieces 112 in line with the third fold lines, at the level of the blank, for example formed by parallelepipeds, are then placed in contact with the blank, for example during transfer.

Next, said compression pieces receive, under pressure (cf. FIG. 18B), the reinforcing elements 22 on the side opposite the joining face, with shapers 113 with a form complementing the form of the reinforcements deployed in order to form the corner pillars and the intermediate pillars.

After withdrawal of the counter-pressure pieces and gripping means, the shapers 113 are removed (see arrow 114—FIG. 18C).

The blank is then transferred with the reinforcing elements formed in the flat state (step 115—FIG. 18A) with the first and second flaps receiving glue (gluing means, not shown), toward the final forming station 116 (FIG. 18C).

The tray is then formed around a punch, for example by piston-like movement in a cavity 117 with punch elements 118 having forms that complement the tray and the flat preformed pillars thereof, and then the tray 1 thus formed is discharged at 119 (FIG. 18C).

Naturally, and as may be seen, furthermore, from the aforesaid, the present invention is not limited to the embodiments more particularly described. On the contrary, the invention encompasses all variants and, notably, those in which the pillars are formed by more than four tongues having thus a polygonal section, those in which the third flaps form platforms, and those in which the tray comprises, furthermore, lids designed in a manner known per se, attached to the tray by gluing points that can easily be torn away laterally simply by separation.

The invention claimed is:

1. A blank for constituting a tray, comprising a rectangular bottom connected by joining lines to four rectangular leaves capable of forming the walls of the tray, the four rectangular leaves including two first opposing leaves, at least one of said first leaves being connected on either side by first fold lines to first flaps, which are themselves connected on their periphery, on the side opposite that located in the extension of the corresponding joining line of the first leaf, to two second flaps by second fold lines, and two opposing adjacent side second leaves, wherein the second leaves each comprise a rectangular central panel of a length shorter than the length of the bottom, said panel being connected at each of the side ends thereof by a third fold line to an element capable of forming a pillar upon forming of the tray.

2. The blank as claimed in claim 1, wherein the element capable of forming a pillar is formed by two, three or four rectangular tongues connected together by fourth fold lines, the first tongues being arranged in order to form said pillar of triangular transverse section and the last, end, tongue being capable of being glued to the inner face of the corresponding second wall.

3. The blank as claimed in claim 1, wherein the last tongue comprises an end forming a tenon protruding relative to the width of the second leaf and in that the bottom of the tray comprises apertures of complementary form arranged in order to be in line with said tenons when the tray is formed for recessed fitting of the tenons of the tray below.

4. The blank as claimed in claim 1, wherein the central panel of each of the second leaves is off-center relative to the central axis of the blank perpendicular to said second leaves.

5. The blank as claimed in claim 4, wherein one of the side ends of each central panel of a second leaf lies in the extension of the joining line with a first leaf, in order to form a corner pillar with the corresponding element upon forming of the tray, the other end of said panel being located at an intermediate level of said second leaf in order to form an intermediate pillar with the other of the elements thereof when said tray is formed.

6. The blank as claimed in claim 1, wherein the elements are symmetrical relative to the central axis of the blank perpendicular to the second leaves in order to form intermediate pillars when the tray is formed.

7. The blank as claimed in claim 1, wherein at least one of the first leaves comprises, at the outer periphery, a third flap connected to said first leaf by a fifth, double, fold line, said third flap being arranged in order to be folded toward the inside when the tray is formed, on the inner face of said corresponding first leaf.

8. The blank as claimed in claim 7, wherein each of the first leaves comprises a third flap.

9. The blank as claimed in claim 7, wherein the first leaf or leaves provided with third flaps are narrower than the second leaves, the end first flaps having a trapezoidal form and being connected to the corresponding second flaps by sixth, double, fold lines, which are oblique relative to the fifth fold line.

10. The blank as claimed in claim 1, wherein the first flaps comprise, moreover, fourth flaps connected respectively to said first flaps by seventh fold lines and located on the side opposite the second flap relative to the first flap.

* * * * *